US008096516B2

(12) United States Patent
Shiao

(10) Patent No.: US 8,096,516 B2
(45) Date of Patent: Jan. 17, 2012

(54) TOOL STORAGE DEVICE

(76) Inventor: Hsuan-Sen Shiao, Taichung Hsien (TW)

( * ) Notice: Subject to any disclaimer, the term of this patent is extended or adjusted under 35 U.S.C. 154(b) by 663 days.

(21) Appl. No.: 12/315,005

(22) Filed: Nov. 26, 2008

(65) Prior Publication Data

US 2010/0025562 A1 Feb. 4, 2010

(30) Foreign Application Priority Data

Jul. 31, 2008 (TW) ..... 97129023 A

(51) Int. Cl.
*A47F 5/00* (2006.01)
*A47H 1/00* (2006.01)

(52) U.S. Cl. ..... 248/298.1; 211/70.6; 248/222.11

(58) Field of Classification Search ..... 248/314, 248/298.1, 220.21, 222.21, 222.52, 224.7; 211/70.6
See application file for complete search history.

(56) References Cited

U.S. PATENT DOCUMENTS

| | | | | |
|---|---|---|---|---|
| 6,092,655 | A * | 7/2000 | Ernst | 206/378 |
| 6,450,338 | B1 * | 9/2002 | Chen | 206/378 |
| 7,118,406 | B2 * | 10/2006 | Mu et al. | 439/419 |
| 7,658,284 | B2 * | 2/2010 | Lin | 206/378 |
| 7,980,400 | B2 * | 7/2011 | Kao | 211/70.6 |
| 2001/0001197 | A1 * | 5/2001 | Ramsey et al. | 206/378 |
| 2005/0103664 | A1 * | 5/2005 | Shih | 206/378 |
| 2007/0017886 | A1 * | 1/2007 | Kao | 211/94.01 |

* cited by examiner

*Primary Examiner* — Amy J Sterling
(74) *Attorney, Agent, or Firm* — Ohlandt, Greeley, Ruggiero & Perle, LLP

(57) ABSTRACT

A tool storage device is adapted for retaining a hand tool thereon, and includes a seat engaging component and a storage unit. The seat engaging component includes a web wall, and top and bottom walls cooperating with the web wall to define a receiving space. Each of the top and bottom walls has a distal edge. The distal edges cooperatively define an opening in spatial communication with the receiving space. The storage unit includes a slidable seat that has a connecting portion extending into the receiving space through the opening, a positioning plate connected to an outer end of the connecting portion and mounted with a positioning seat, and upper and lower engaging components disposed in the receiving space, each extending from an inner end of the connecting portion and abutting resiliently against the web wall of the seat engaging component.

16 Claims, 10 Drawing Sheets

TOOL STORAGE DEVICE

CROSS-REFERENCE TO RELATED APPLICATION

This application claims priority of Taiwanese Application No. 097129023, filed on Jul. 31, 2008.

BACKGROUND OF THE INVENTION

1. Field of the Invention

The invention relates to a storage device, more particularly to a tool storage device.

2. Description of the Related Art

As shown in FIG. 1, a conventional tool storage device is adapted for retaining a socket 3 thereon, and comprises a slide rail component 1 and a storage unit 2 coupled slidably to the slide rail component 1. The slide rail component 1 has two lateral sides, each of which is formed with parallel first and second serration rows 101, 102 that define cooperatively a slide groove 103 therebetween. The storage unit 2 includes a base 201, a supporting member 202 mounted on the base 201, a resilient upright bar 203 formed with a socket-contacting component 203' that is resiliently movable relative to the supporting member 202 for contacting the socket 3, and a resilient arm 204 interconnecting resiliently the supporting member 202 and the upright bar 203. The base 201 has opposite clip plates 205, each formed with an internal projection 205' for engaging slidably a respective one of the first and second serration rows 101, 102 at a corresponding one of the lateral sides of the slide rail component 1, and a groove-engaging portion 206 extending perpendicularly and inwardly from a lower end thereof for engaging slidably the slide groove 103 at the corresponding one of the lateral sides of the slide rail component 1. Therefore, the storage unit 2 is movable along and positioned relative to the slide rail component 1 while the socket 3 is retained thereon. However, the structure of the conventional tool storage device is relatively complicated, thereby resulting in difficulties in manufacturing the conventional tool storage device.

Referring to FIG. 2, another conventional tool storage device includes a base seat 4, a hollow positioning seat 5, and a retaining ball 6. The base seat 4 has a portion disposed in the positioning seat 5, such that the positioning seat 5 is rotatable and movable relative to the base seat 4. The portion of the base seat 4 disposed in the positioning seat 5 is formed in a stepped configuration having a small diameter segment 401 and a large diameter segment 402 that has a diameter larger than that of the small diameter segment 401. The positioning seat 5 has a through hole 501 for receiving movably the retaining ball 6. When the positioning seat 5 is moved to a position where the receiving hole 501 corresponds in position to the small diameter segment 401 of the portion of the base seat 4, the retaining ball 6 can be moved toward the small diameter segment 401 to retract into the positioning seat 5, such that a socket 7 can be easily sleeved on or removed from the positioning seat 5. On the contrary, when the positioning seat 5 is moved to another position where the receiving hole 501 corresponds in position to the large diameter segment 402 of the portion of the base seat 4, the retaining ball 6 is pushed by the large diameter segment 402 to move away from the large diameter segment 402, such that a portion of the retaining ball 6 will be exposed from the positioning seat 5 to press against an inner surface of the socket 7, thereby positioning the socket 7 on the positioning seat 5. However, this conventional tool storage device also has a relatively complicated structure.

SUMMARY OF THE INVENTION

Therefore, the object of the present invention is to provide a tool storage device that has a relatively simple structure.

Accordingly, a tool storage device of the present invention is adapted for retaining a hand tool thereon. The tool storage device comprises a seat engaging component and a storage unit. The seat engaging component includes an elongated web wall having opposite top and bottom edges, and top and bottom walls extending respectively from the upper and lower edges of the web wall and cooperating with the web wall to define a receiving space thereamong. Each of the top and bottom walls has a bent end segment that has an inner surface facing the receiving space, an outer surface opposite to the inner surface, and a distal edge distal from the web wall. The distal edges of the bent end segments cooperatively define an opening therebetween that is in spatial communication with the receiving space. The storage unit includes a slidable seat engaging slidably the receiving space in the seat engaging component, and a positioning seat mounted on the slidable seat and adapted for retaining the hand tool thereon. The slidable seat has a connecting portion, a positioning plate, and upper and lower engaging components. The connecting portion extends through the opening, and has an outer end exposed from the outer surfaces of the bent end segments of the top and bottom walls of the seat engaging component, an inner end opposite to the outer end and extending into the receiving space and opposite upper and lower surfaces confronting respectively the distal edges of the bent end segments of the top and bottom walls of the seat engaging component. The positioning plate is connected to the outer end of the connecting portion and is mounted with the positioning seat. The upper and lower engaging components are disposed in the receiving space of the seat engaging component. Each of the upper and the lower engaging components has a connecting section extending from a respective one of the upper and lower surfaces of the connecting portion and abutting against the inner surface of the bent end segment of a respective one of the top and bottom walls of the seat engaging component, a resilient end section spaced apart from the connecting section and having a distal end that abuts resiliently against the web wall of the seat engaging component, and an intermediate section interconnecting the connecting section and the resilient end section. A distance between the intermediate sections of the upper and lower engaging components is longer than that between the distal ends of the resilient end sections of the upper and lower engaging components.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
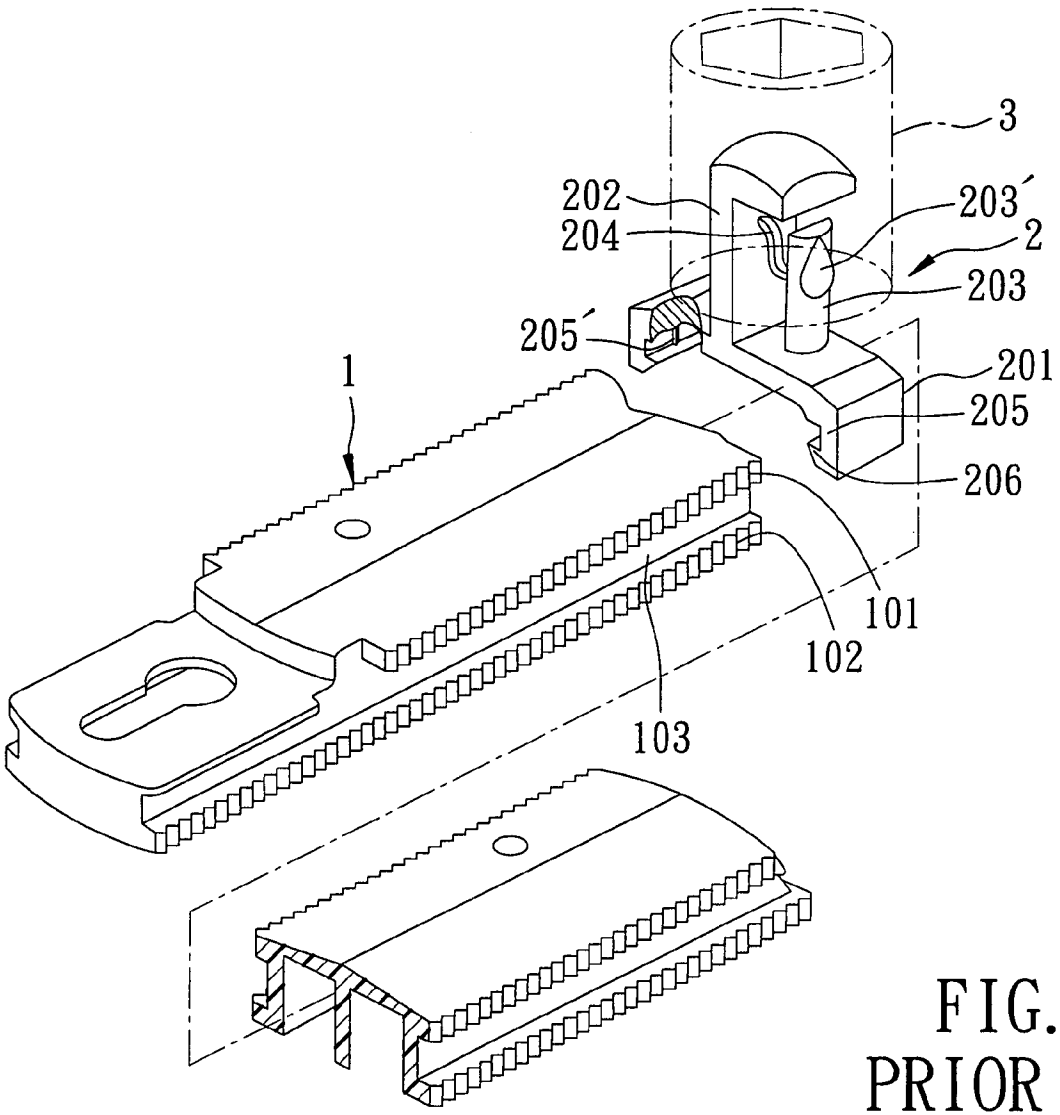
FIG. 1 PRIOR ART
FIG. 1 is a partly sectional, exploded perspective view of a conventional tool storage device.
Figure 2:
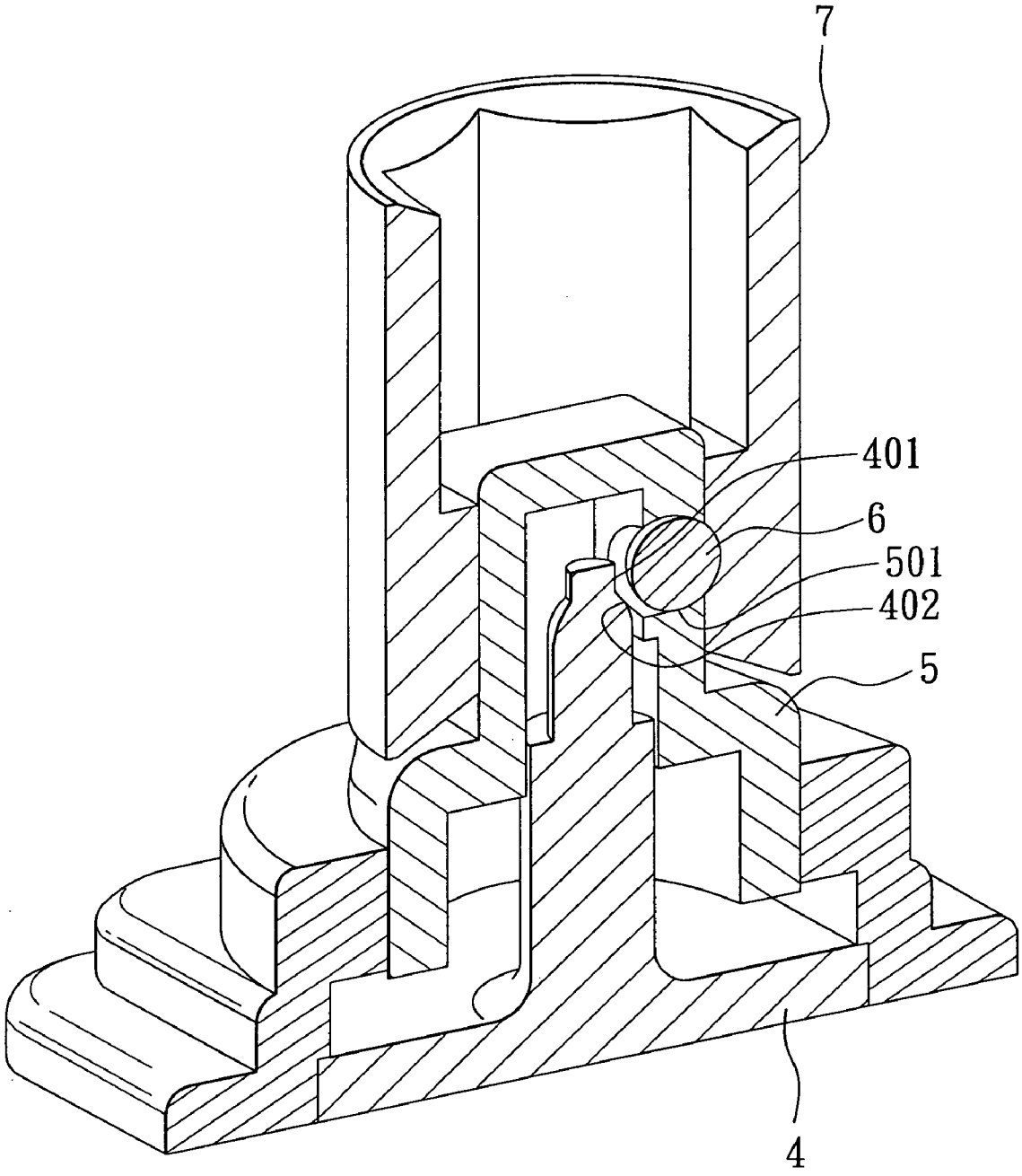
FIG. 2 PRIOR ART
FIG. 2 is a sectional perspective view of another conventional tool storage device.
Figure 3:
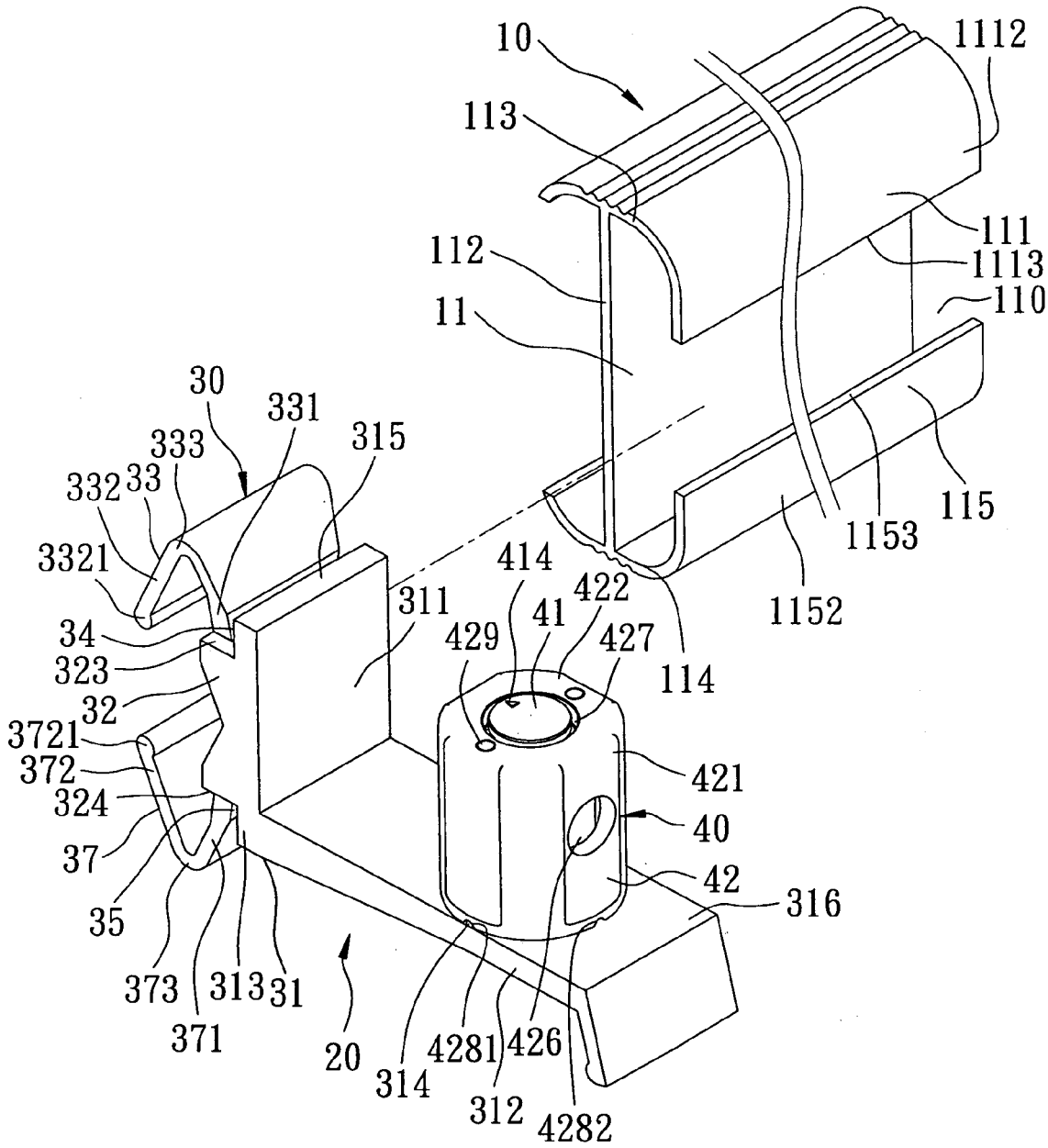
FIG. 3 is a partly exploded perspective view of a first preferred embodiment of a tool storage device according to the invention.
Figure 4:
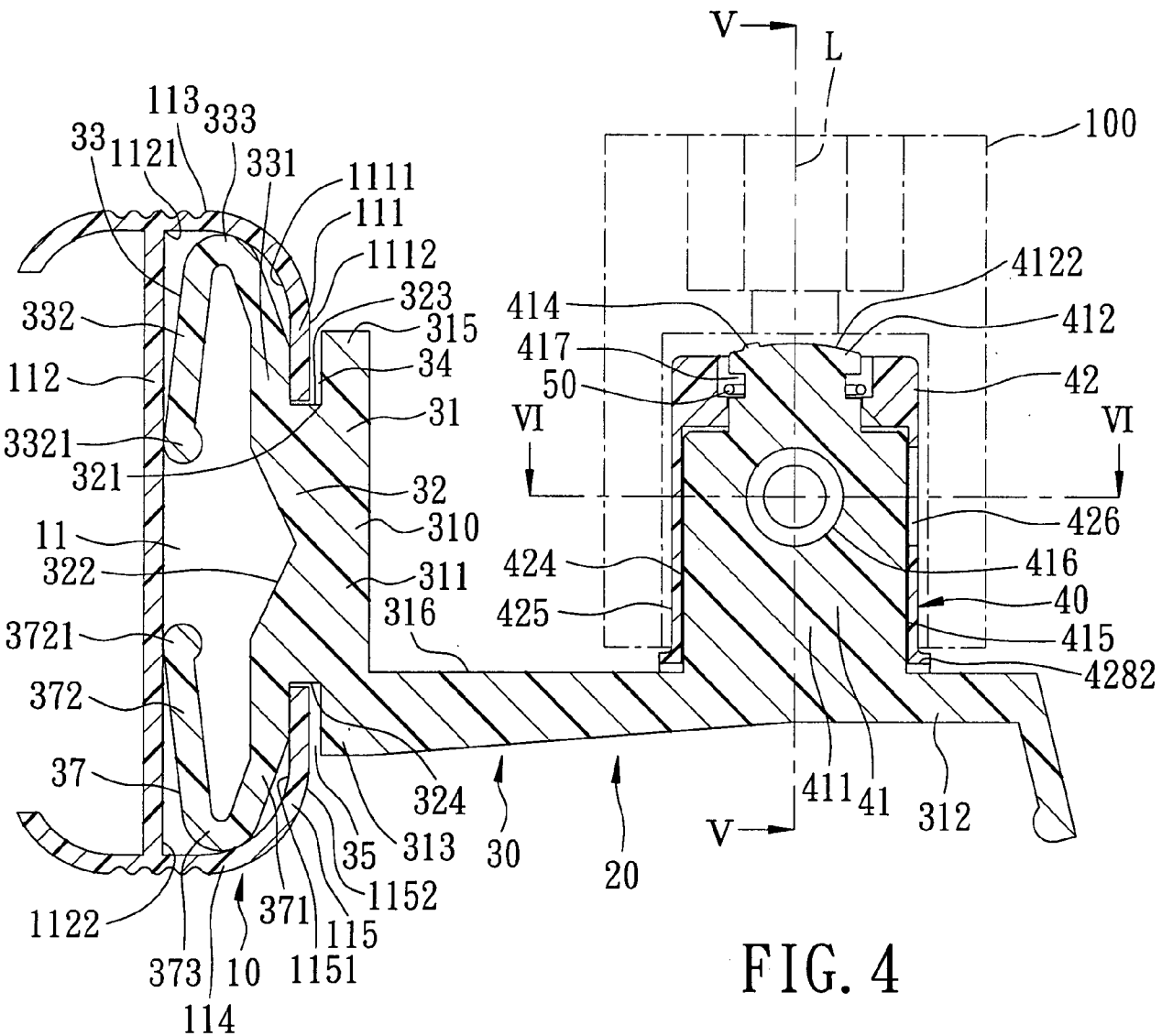
FIG. 4 is a sectional view of the first preferred embodiment.
Figure 5:
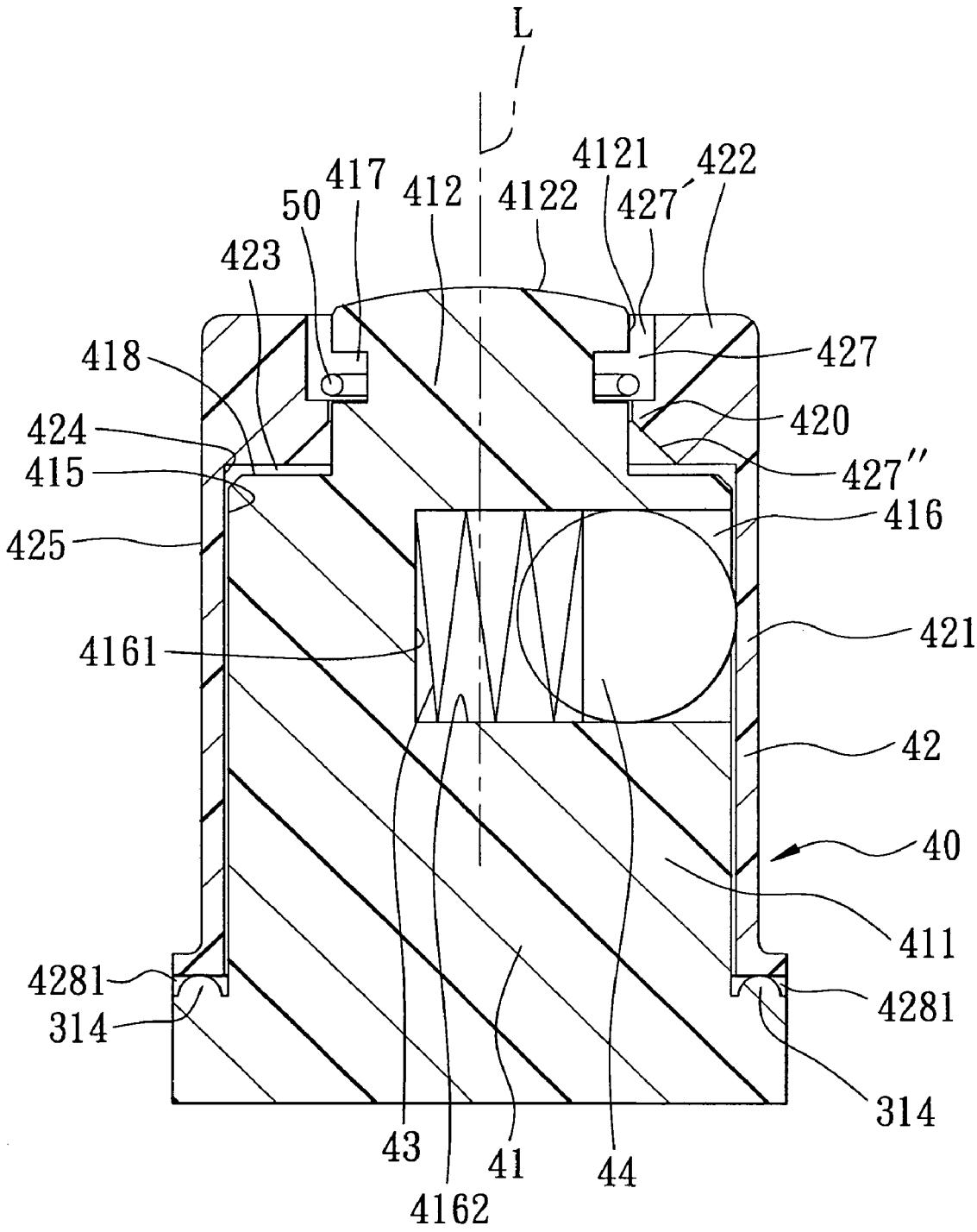
FIG. 5 is another sectional view of the first preferred embodiment taken along line V-V in FIG. 4.
Figure 6:
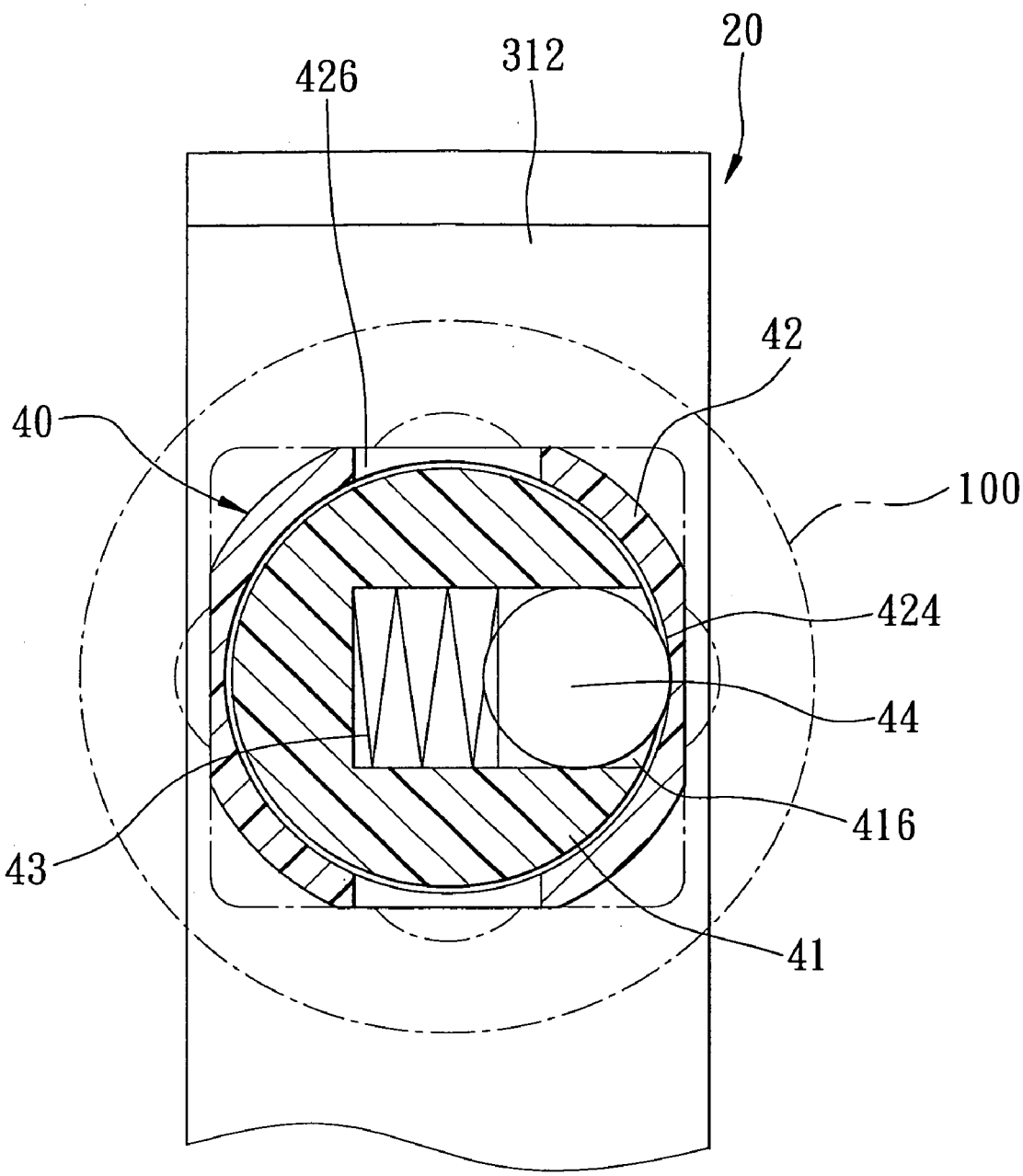
FIG. 6 is still another sectional view of the first preferred embodiment taken along line VI-VI in FIG. 4, illustrating a rotatable sleeve at a socket-releasing position.

As shown in FIGS. 3, 4, and 5, the first preferred embodiment of a tool storage device according to the present invention is adapted for retaining a hand tool, such as a socket 100. The tool storage device comprises a seat engaging component 10 and a storage unit 20.

The seat engaging component 10 includes an elongated web wall 112 that has top and bottom edges 1121, 1122, and top and bottom walls 113, 114 that extend respectively from the upper and lower edges 1121, 1122 and that cooperate with the web wall 112 to define a receiving space 11 thereamong. Each of the top and bottom walls 113, 114 has a bent end segment 111, 115 that has an inner surface 1111, 1151 facing the receiving space 11, an outer surface 1112, 1152 opposite to the inner surface 1111, 1151, and a distal edge 1113, 1153 distal from the web wall 112. The distal edges 1113, 1153 of the bent end segments 111, 115 cooperatively define an elongated opening 110 therebetween that is in spatial communication with the receiving space 11.

The storage unit 20 includes a slidable seat 30 engaging slidably the receiving space 11 in the seat engaging component 10, and a positioning seat 40 mounted on the slidable seat 30 and adapted for retaining the socket 100 thereon.

The slidable seat 30 has a connecting portion 32, a positioning plate 31, and upper and lower engaging components 33, 37.

The connecting portion 32 has an outer end 321 exposed from the outer surfaces 1112, 1152 of the bent end segments 111, 115 of the top and bottom walls 113, 114 of the seat engaging component 10, an inner end 322 opposite to the outer end 321 and extending into the receiving space 11 of the seat engaging component 10 through the opening 110, and opposite upper and lower surfaces 323, 324 confronting respectively the distal edges 1113, 1153 of the bent end segments 111, 115 of the top and bottom walls 113, 114 of the seat engaging component 10.

In this embodiment, the positioning plate 31 is an L-shaped plate, and has an upright reference portion 310 coupled to the outer end 321 of the connecting portion 32, and a projecting arm 312 projecting perpendicularly from a lower end of the reference portion 310 and having a seat mounting surface 316 on which the positioning seat 40 is mounted. In this embodiment, the seat mounting surface 316 is formed with a pair of positioning protrusions 314 that are spaced apart from each other by 180 degrees (see FIG. 5). In this embodiment, the reference portion 310 has an intermediate portion 311 which is coupled to the connecting portion 32, a lower end portion 313 from which the projecting arm 312 projects, and an upper end portion 315.

The upper and lower engaging components 33, 37 are disposed in the receiving space 11 of the seat engaging component 10. Each of the upper and lower engaging components 33, 37 has a connecting section 331, 371 extending from a respective one of the upper and lower surfaces 323, 324 of the connecting portion 32 of the slidable seat 30 and abutting against the inner surface 1111, 1151 of the bent end segment 111, 115 of a respective one of the top and bottom walls 113, 114 of the seat engaging component 10, a resilient end section 332, 372 spaced apart from the connecting section 331, 371 and having a distal end 3321, 3721 that abuts resiliently against the web wall 112 of the seat engaging component 10, and an intermediate section 333, 373 interconnecting the connecting section 331, 371 and the resilient end section 332, 372. A distance between the intermediate sections 333, 373 is longer than that between the distal ends 3321, 3721 of the resilient end section 332, 372 of the upper and lower engaging components 33, 37. In this embodiment, the distal end 3321, 3721 of the resilient end sections 332, 372 of each of the upper and lower engaging components 33, 37 has a round cross-section. In this embodiment, the lower end portion 313 of the reference portion 310 of the positioning plate 31 of the slidable seat 30 cooperates with the connecting portion 32 of the slidable seat 30 and the connecting section 371 of the lower engaging component 37 to define a first slide groove 35 for receiving slidably the bent end segment 115 of the bottom wall 114 of the seat engaging component 10 therein, while the upper end portion 315 of the reference portion 310 of the positioning plate 31 cooperates with the connecting portion 32 of the slidable seat 30 and the connecting section 331 of the upper engaging component 33 to define a second slide groove 34 for receiving slidably the bent end segment 111 of the top wall 113 of the seat engaging component 10 therein. Therefore, the stability of the engagement between the slidable seat 30 and the seat engaging component 10 is enhanced.

The positioning seat 40 includes a positioning stem 41, a rotatable sleeve 42, a positioning component 44, and a spring 43.

In this embodiment, the positioning stem 41 projects uprightly from the seat mounting surface 316 of the projecting arm 312 of the positioning plate 31 of the slidable seat 30 along an axis (L), and has a main portion 411 connected to the seat mounting surface 316 of the projecting arm 312 of the positioning plate 31 and having an annular outer surface 415 that surrounds the axis (L), an end surface 418 that is disposed at an end of the main portion 411 axially opposite to the seat mounting surface 316, and an inner hole 416 that extends radially and inwardly from the annular outer surface 415. The inner hole 416 is defined cooperatively by a radial end surface 4161 and a surrounding side surface 4162 connected to the radial end surface 4161. The positioning stem 41 further has a limiting portion 412 projecting axially from the end surface 418 of the main portion 411, having a diameter that is smaller than that of the main portion 411, and having an annular external surface 4121 that is formed with an annular groove 417, a distal end surface 4122 that is axially opposite to the end surface 418 of the main portion 411, and an indicating portion 414 that is formed on the distal end surface 4122. The storage unit 20 further includes a retaining component 50 retained in the annular groove 417 and having a portion exposed from the annular external surface 4121 of the limiting portion 412. In this embodiment, the retaining component 50 is a C-ring.

The rotatable sleeve 42 is sleeved rotatably on the positioning stem 41, and includes a surrounding wall 421 surrounding the axis (L) and having an inner surrounding surface 424 that confronts the annular outer surface 415 of the positioning stem 41, an outer surrounding surface 425 that is disposed radially opposite to the inner surrounding surface 424, and a through hole 426 that extends radially from the inner surrounding surface 424 to the outer surrounding surface 425. The rotatable sleeve 42 further includes an end wall 422 connected to one end of the surrounding wall 421 that is axially opposite to the seat mounting surface 316 of the projecting arm 312 of the positioning plate 31 of the slidable seat 30, cooperating with the surrounding wall 421 to define a retaining space 423 for retaining rotatably the main portion 411 of the positioning stem 41 therein, and having a stepped hole 427 that is in spatial communication with the retaining space 423 and that receives rotatably the limiting portion 412 of the positioning stem 41 and the retaining component 50 therein. The stepped hole 427 has a large diameter hole portion 427' that corresponds in position to the annular groove 417 in the limiting portion 412 of the positioning stem 41 and a part of the annular external surface 4121 of the limiting portion 412 of the positioning stem 41 distal from the main portion 411 of the positioning stem 41 along the axis (L), and a small diameter hole portion 427" that has a diameter smaller than that of the large diameter hole portion 427' to define a shoulder 420 between the large and small diameter hole portions 427', 427", and that corresponds in position to another part of the annular external surface 4121 of the limiting portion 412 of the positioning stem 41 located between the annular groove 417 and the main portion 411 of the positioning stem 41. The small diameter hole portion 427" of the stepped hole 427 tapers from an end thereof adjacent to the receiving space 423 toward the large diameter hole portion 427'. During the assembly process of the rotatable sleeve 42 and the positioning stem 41, the retaining component 50 contracts through guidance of the tapered configuration of the small diameter hole portion 427" and subsequently expands so that it is movable to abut against the shoulder 420 to thereby retain the rotatable sleeve 42 on the positioning stem 41.

The positioning component 44 is disposed movably in the inner hole 416 of the main portion 411 of the positioning stem 41 of the positioning seat 40. In this embodiment, the positioning component 44 is formed as a ball.

The spring 43 is disposed in the inner hole 416 of the main portion 411 of the positioning stem 41 of the positioning seat 40, and has opposite ends that abut resiliently and respectively against the radial end surface 4161 of the inner hole 416 and the positioning component 44.

The rotatable sleeve 42 of the positioning seat 40 can be received fittingly within the socket 100.

The rotatable sleeve 42 of the positioning seat 40 is rotatable relative to the positioning stem 41 of the positioning seat 40 between a socket-releasing position (see FIGS. 3 to 6), where the inner hole 416 in the main portion 411 of the positioning stem 41 is not registered with the through hole 426 in the surrounding wall 421 of the rotatable sleeve 42, such that the positioning component 44 is retracted into the inner hole 416 and is biased by the spring 43 to abut resiliently against the inner surrounding surface 424 of the surrounding wall 421 of the rotatable sleeve 42, and a socket-retaining position (see FIGS. 7 and 8), where the inner hole 416 in the main portion 411 of the positioning stem 41 is registered with the through hole 426 in the surrounding wall 421 of the rotatable sleeve 42, such that the positioning component 44 is biased to move radially and outwardly by the spring 43, and such that a portion of the positioning component 44 is exposed from the through hole 426 and is adapted to press against an inner surface of the socket 100 sleeved thereon, thereby positioning the socket 100 on the rotatable sleeve 42. In this embodiment, the surrounding wall 421 of the rotatable sleeve 42 further has a pair of first recesses 4281 that are angularly spaced apart from each other by 180 degrees for engaging respectively the positioning protrusions 314 at the projecting arm 312 of the positioning plate 31 of the slidable seat 30 when the rotatable sleeve 42 is at the socket-releasing position, and a pair of second recesses 4282 that are angularly spaced apart from each other by 180 degrees and that are angularly spaced apart from the first recesses 4281 for engaging respectively the positioning protrusions 314 when the rotatable sleeve 42 is at the socket-retaining position. The end wall 422 of the rotatable sleeve 42 further has a pair of mark portions 429 aligned respectively with the first recesses 4281 along a direction parallel to the axis (L), and corresponding in position to the indicating portion 414 of the positioning stem 41 when the rotatable sleeve 42 is at the socket-retaining position.

Figure 7:
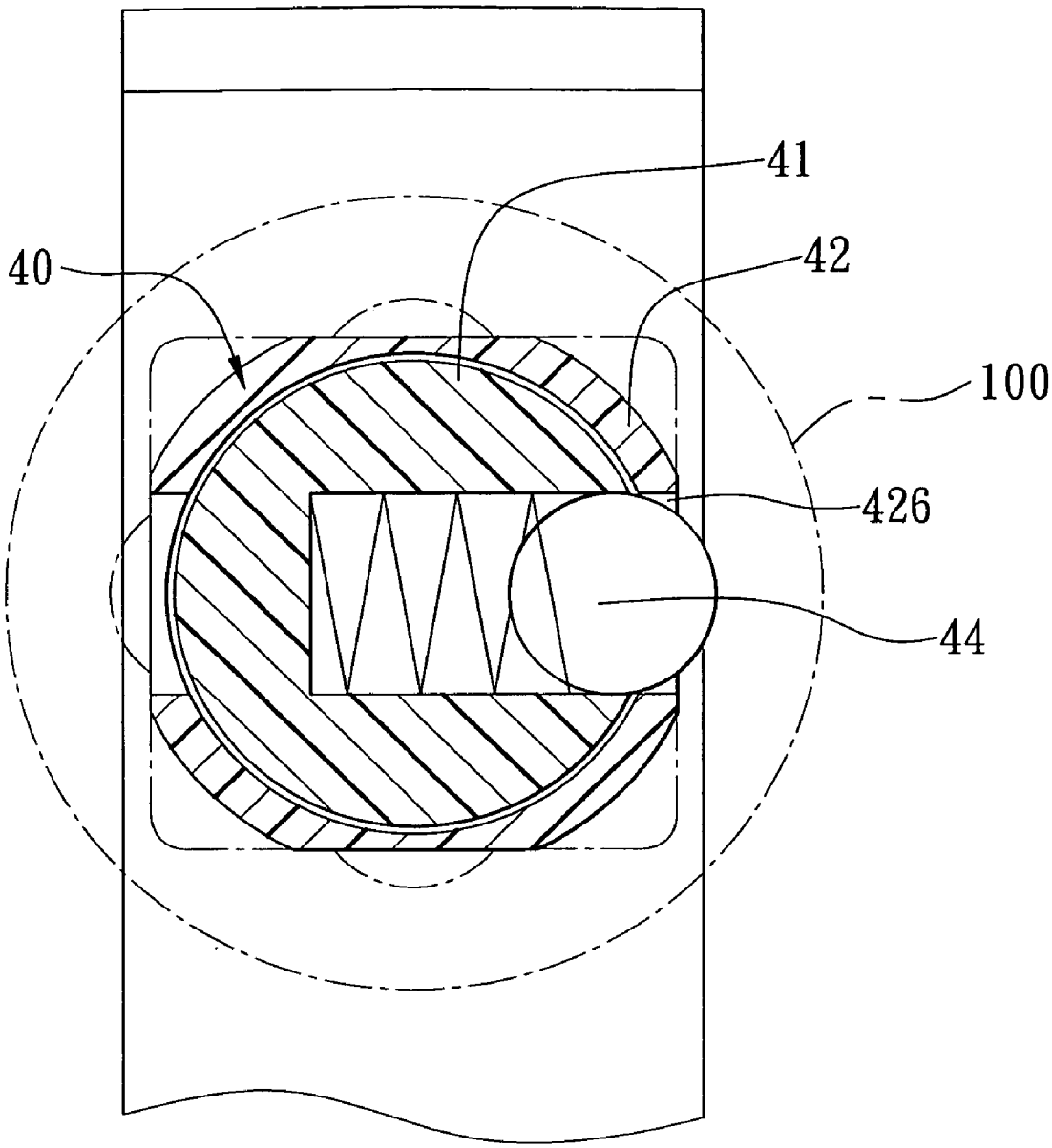
FIG. 7 is a view similar to FIG. 6, but illustrating the rotatable sleeve at a socket-retaining position.
Figure 8:
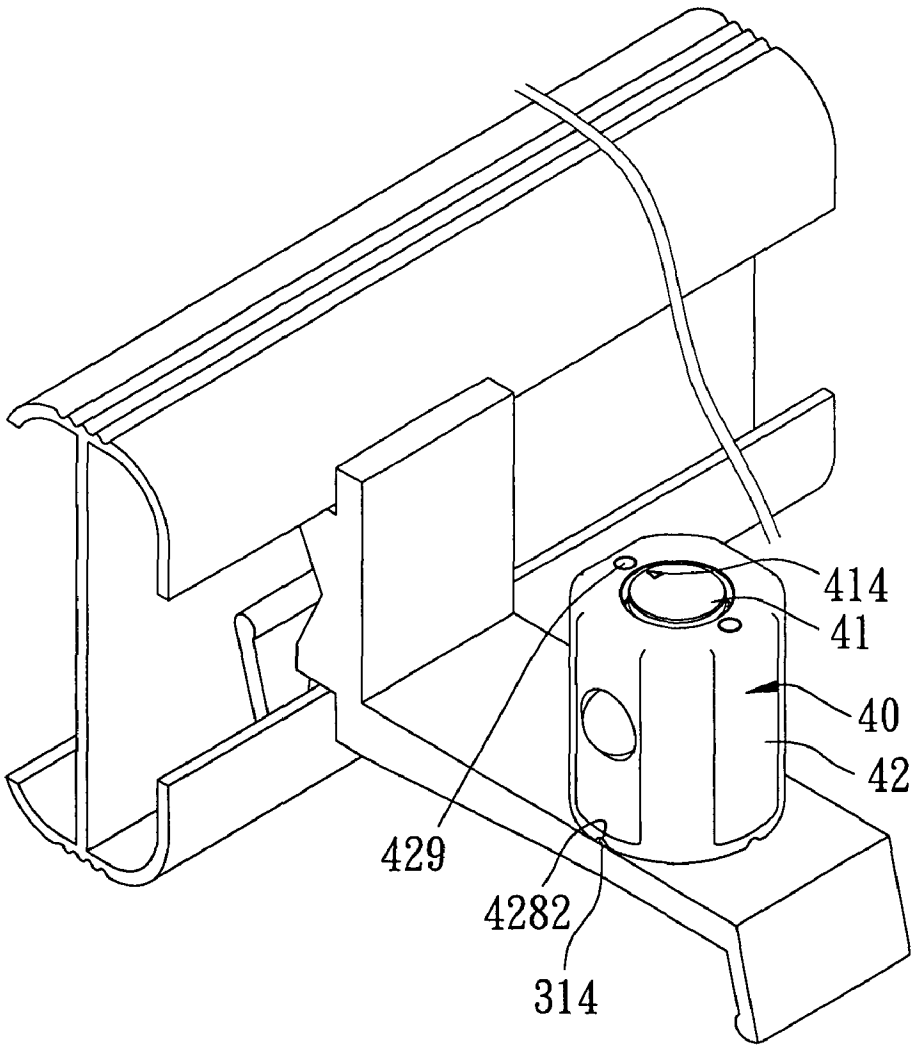
FIG. 8 is an assembled perspective view of the first preferred embodiment.

Referring to FIGS. 3 to 6, when the rotatable sleeve 42 of the positioning seat 40 is at the socket-releasing position, the socket 100 can be sleeved on the positioning seat 40. At that time, the rotatable sleeve 42 is positioned relative to the slidable seat 30 by engagement between the first recesses 4281 in the surrounding wall 421 of the rotatable sleeve 42 and the positioning protrusions 314 of the positioning plate 310 of the slidable seat 30. Afterward, as shown in FIGS. 7 and 8, the socket 100 can be rotated about the axis (L) along with the rotatable sleeve 42 until the rotatable sleeve 42 is rotated to the socket-retaining position. At that time, the rotatable sleeve 42 is positioned again relative to the slidable seat 30 by engagement between the second recesses 4282 in the surrounding wall 421 of the rotatable sleeve 42 and the positioning protrusions 314. By rotating the socket 100 reversely along with the rotatable sleeve 42 until the rotatable sleeve 42 is rotated from the socket-retaining position back to the socket-releasing position, the socket 100 can be easily removed from the positioning seat 40.

Therefore, the tool storage device of this embodiment can be easily operated for retaining and releasing the socket 100. Additionally, each of the seat engaging component 10, the slidable seat 30 of the storage unit 20, and the positioning seat 40 of the storage unit 20 has a relatively simple structure, such that the tool storage device of this embodiment is easy to be manufactured. Moreover, the presence of the mark portions 429 of the rotatable sleeve 42 of the positioning seat 40 and the indicating portion 414 of the positioning stem 41 of the positioning seat 40 facilitates operation of the tool storage device of the invention. Furthermore, the slidable seat 30 is slidable relative to the seat engaging component 10, and can be positioned relative to the engaging component 10 at a desired position via abutment of the upper and lower engaging components 33, 37 against the web wall 112 of the seat engaging component 10, thereby enhancing flexibility during use.

Figure 9:
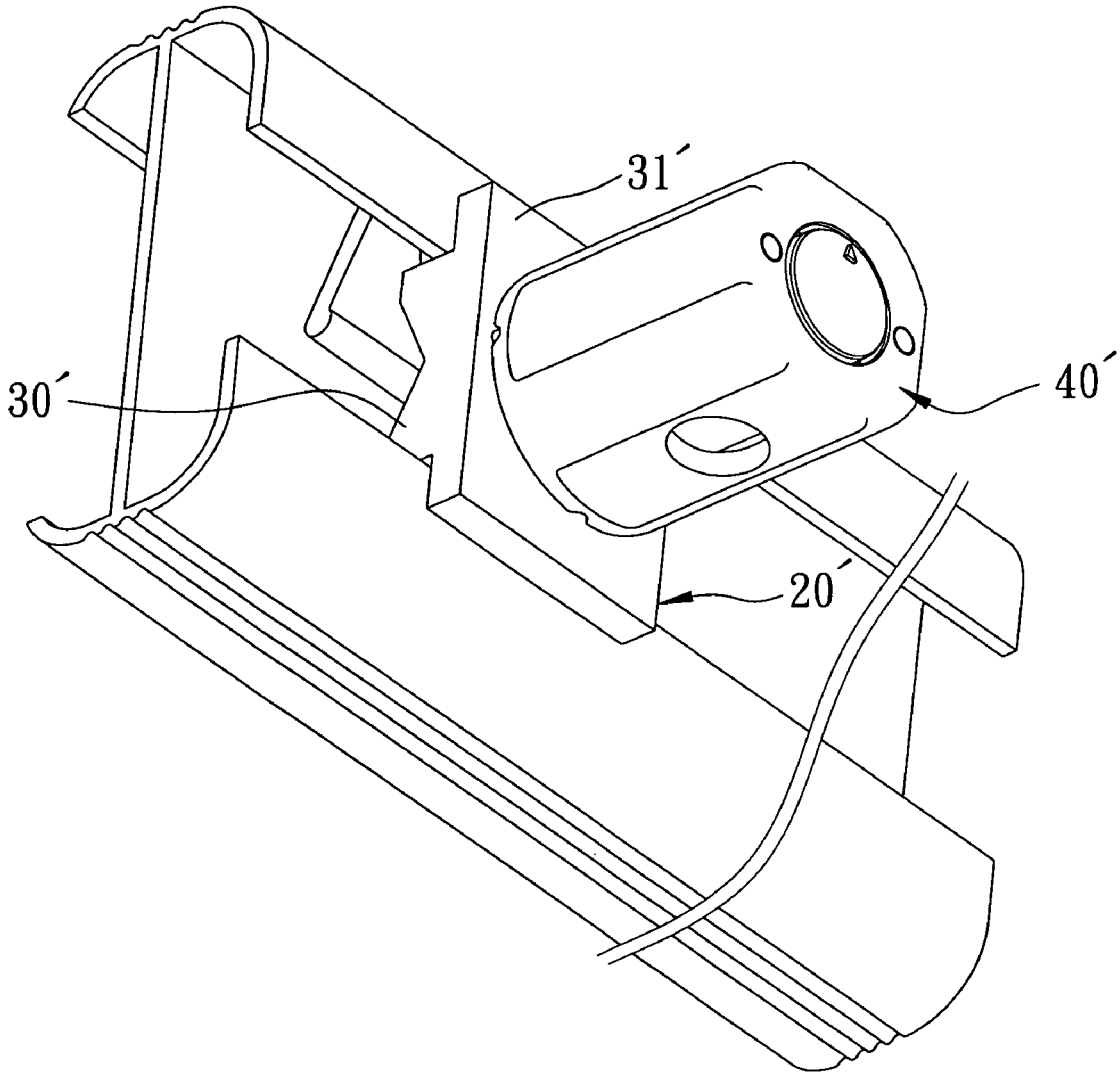
FIG. 9 is an assembled perspective view of a second preferred embodiment of the tool storage device according to the invention.
Figure 10:
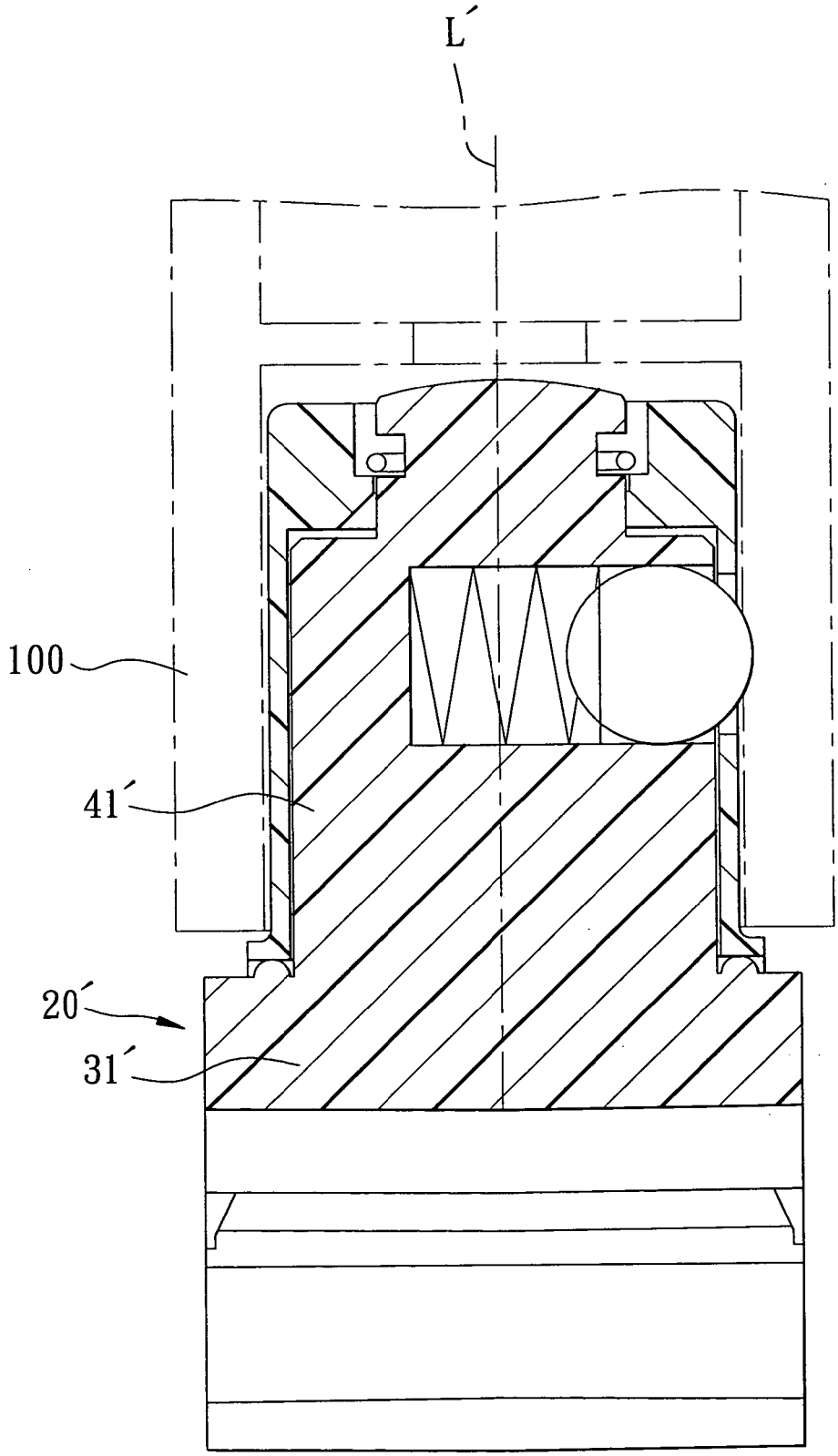
FIG. 10 is a sectional view of the second preferred embodiment.

As shown in FIGS. 9 and 10, the second preferred embodiment of the tool storage device according to the present invention has a structure similar to that of the first embodiment. The main difference between this embodiment and the previous embodiment resides in the configuration of the positioning plate 31'. In this embodiment, the positioning plate 31' of the slidable seat 30' of the storage unit 20' is a flat plate that is disposed uprightly. The positioning stem 41' of the positioning seat 40' projects perpendicularly from the positioning plate 31' along an axis (L') normal to the positioning plate 31', i.e., the positioning stem 41' projects horizontally from the positioning plate 31'. The second preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A tool storage device adapted for retaining a hand tool thereon, said tool storage device comprising:

a seat engaging component including an elongated web wall that has opposite top and bottom edges, and top and bottom walls that extend respectively from said upper and lower edges of said web wall and that cooperate with said web wall to define a receiving space thereamong, each of said top and bottom walls having a bent end segment that has an inner surface facing said receiving space, an outer surface opposite to said inner surface, and a distal edge distal from said web wall, said distal edges of said bent end segments cooperatively defining an opening therebetween that is in spatial communication with said receiving space; and a storage unit including a slidable seat engaging slidably said receiving space in said seat engaging component, and a positioning seat mounted on said slidable seat and adapted for retaining the hand tool thereon, said slidable seat having a connecting portion that extends through said opening, and that has an outer end exposed from said outer surfaces of said bent end segments of said top and bottom walls of said seat engaging component, an inner end opposite to said outer end and extending into said receiving space, and opposite upper and lower surfaces confronting respectively said distal edges of said bent end segments of said top and bottom walls of said seat engaging component, a positioning plate that is connected to said outer end of said connecting portion and that is mounted with said positioning seat, and upper and lower engaging components that are disposed in said receiving space of said seat engaging component, each of said upper and lower engaging components having a connecting section extending from a respective one of said upper and lower surfaces of said connecting portion and abutting against said inner surface of said bent end segment of a respective one of said top and bottom walls of said seat engaging component, a resilient end section spaced apart from said connecting section and having a distal end that abuts resiliently against said web wall of said seat engaging component, and an intermediate section interconnecting said connecting section and said resilient end section;

wherein a distance between said intermediate sections of said upper and lower engaging components is longer than that between said distal ends of said resilient end sections of said upper and lower engaging components.

2. The tool storage device as claimed in claim 1, wherein said positioning plate of said slidable seat of said storage unit has an upright reference portion that includes an intermediate portion coupled to said connecting portion of said slidable seat, and a lower end portion cooperating with said connecting portion of said slidable seat of said storage unit and said connecting section of said lower engaging component to define a first slide groove thereamong for receiving slidably said bent end segment of said bottom wall of said seat engaging component.

3. The tool storage device as claimed in claim 2, wherein said upright reference portion of said positioning plate of said slidable seat further has an upper end portion cooperating with said connecting portion of said slidable seat and said connecting section of said upper engaging component to define a second slide groove thereamong for receiving slidably said bent end segment of said top wall of said seat engaging component.

4. The tool storage device as claimed in claim 1, wherein said distal end of said resilient end section of each of said upper and lower engaging components of said slidable seat has a round cross-section.

5. A tool storage device adapted for retaining a socket thereon, said tool storage device comprising an elongated seat engaging component, and a storage unit including a slidable seat that engages slidably said seat engaging component, and a positioning seat that is mounted on said slidable seat and that includes a positioning stem projecting from a portion of said slidable seat along an axis, and having an annular outer surface that surrounds the axis, and an inner hole that extends radially and inwardly from said annular outer surface and that is defined cooperatively by a radial end surface, and a surrounding side surface connected to said radial end surface, a rotatable sleeve sleeved rotatably on said positioning stem, and having an inner surrounding surface that confronts said annular outer surface of said positioning stem, an outer surrounding surface that is disposed radially opposite to said inner surrounding surface, and a through hole that extends radially from said inner surrounding surface to said outer surrounding surface, a positioning component disposed movably in said inner hole of said positioning stem, and a spring disposed in said inner hole, and having opposite ends that abut resiliently and respectively against said radial end surface and said positioning component;

wherein said rotatable sleeve is rotatable relative to said positioning stem between a socket-releasing position, where said inner hole in said positioning stem is not registered with said through hole in said rotatable sleeve, such that said positioning component is retracted into said inner hole and is biased by said spring to abut resiliently against said inner surrounding surface of said rotatable sleeve, and a socket-retaining position, where said inner hole in said positioning stem is registered with said through hole in said rotatable sleeve, such that said positioning component is biased to move radially and outwardly by said spring, and such that a portion of said positioning component is exposed from said through hole in said rotatable sleeve and is adapted to press against an inner surface of the socket, thereby positioning the socket on said rotatable sleeve.

6. The tool storage device as claimed in claim 5, wherein said positioning component of said positioning seat of said storage unit is formed as a ball.

7. The tool storage device as claimed in claim 5, wherein:

said positioning stem of said positioning seat of said storage unit has a main portion connected to said slidable seat, and having said annular outer surface that is formed with said inner hole, and an end surface that is disposed at an end of said main portion axially opposite to said portion of said slidable seat, a limiting portion projecting axially from said end surface of said main portion, having a diameter smaller than that of said main portion, and having an annular external surface that is formed with an annular groove;

said storage unit further includes a retaining component retained in said annular groove and having a portion exposed from said annular external surface of said limiting portion; and said rotatable sleeve of said positioning seat of said storage unit includes a surrounding wall surrounding the axis, having said inner and outer surrounding surfaces, and formed with said through hole, an end wall connected to one end of said surrounding wall that is axially opposite to said portion of said slidable seat, cooperating with said surrounding wall to define a retaining space for retaining rotatably said main portion of said positioning stem therein, and having a stepped hole that is in spatial communication with said retaining space and that receives rotatably said limiting portion of said positioning stem and said retaining component therein, said stepped hole having a large diameter hole portion that corresponds in position to said annular groove in said limiting portion and a part of said annular external surface of said limiting portion distal from said main portion along the axis, and a small diameter hole portion that has a diameter smaller than that of said large diameter hole portion to define a shoulder between said large and small diameter hole portions and that corresponds in position to another part of said annular external surface of said limiting portion located between said annular groove and said main portion of said positioning stem, said retaining component being movable within said annular groove to abut against said shoulder.

8. The tool storage device as claimed in claim 7, wherein said retaining component of said storage unit is a c-ring.

9. The tool storage device as claimed in claim 7, wherein said small diameter hole portion of said stepped hole of said rotatable sleeve of said positioning seat tapers from an end thereof adjacent to said receiving space of said rotatable sleeve toward said large diameter hole portion of said stepped hole of said rotatable sleeve.

10. The tool storage device as claimed in claim 5, wherein:

said seat engaging component is hollow and has an elongated opening; and said slidable seat of said storage unit has a connecting portion that is disposed slidably in said opening, and that has an outer end exposed from said seat engaging component, an inner end opposite to said outer end and extending into said seat engaging component through said opening, and upper and lower surfaces, a positioning plate that is connected to said outer end of said connecting portion and that is mounted with said positioning seat, and upper and lower engaging components that are disposed in said receiving space in said seat engaging component, said upper and lower engaging components extending respectively from said upper and lower surfaces of said connecting portions.

11. The tool storage device as claimed in claim 10, wherein said positioning plate of said slidable seat of said storage unit is an L-shaped plate, and has an upright reference portion coupled to said connecting portion of said slidable seat, and a projecting arm projecting perpendicularly from a lower end of said upright reference portion and mounted with said positioning seat of said storage unit.

12. The tools storage device as claimed in claim 11, wherein:

said projecting arm of said positioning plate of said slidable seat of said storage unit has a seat mounting surface on which said positioning seat of said storage unit is mounted, said seat mounting surface constituting said portion of said slidable seat;

said seat mounting surface is formed with a pair of positioning protrusions angularly spaced apart from each other; and said surrounding wall of said rotatable sleeve of said positioning seat of said storage unit further has a pair of angularly spaced-apart first recesses for engaging respectively said positioning protrusions when said rotatable sleeve is at the socket-releasing position, and a pair of angularly spaced-apart second recesses that are angularly spaced apart from said first recesses for engaging respectively said positioning protrusions when said rotatable sleeve is at the socket-retaining position.

13. The tool storage device as claimed in claim 12, wherein:

said positioning stem of said positioning seat of said storage unit further has a distal end surface axially opposite to said portion of said slidable seat of said storage unit, and an indicating portion formed on said distal end surface; and said end wall of said rotatable sleeve of said positioning seat further has a pair of mark portions aligned respectively with said first recesses in said surrounding wall along a direction parallel to the axis, and corresponding in position to said indicating portion of said positioning stem when said rotatable sleeve is at the socket-retaining position.

14. The tool storage device as claimed in claim 10, wherein said positioning plate of said slidable seat of said storage unit is a flat plate that is normal to the axis.

15. The tool storage device as claimed in claim 14, wherein:

said positioning plate of said slidable seat of said storage unit is formed with a pair of positioning protrusions angularly spaced apart from each other; and said surrounding wall of said rotatable sleeve of said positioning seat of said storage unit further has a pair of angularly spaced-apart first recesses for engaging respectively said positioning protrusions when said rotatable sleeve is at the socket-releasing position, and a pair of angularly spaced-apart second recesses that are angularly spaced apart from said first recesses for engaging respectively said positioning protrusions when said rotatable sleeve is at the socket-retaining position.

16. The tool storage device as claimed in claim 15, wherein:

said positioning stem of said positioning seat of said storage unit further has a distal end surface axially opposite to said portion of said slidable seat of said storage unit, and an indicating portion formed on said distal end surface; and said end wall of said rotatable sleeve of said positioning seat further has a pair of mark portions aligned respectively with said first recesses in said surrounding wall along a direction parallel to the axis, and corresponding in position to said indicating portion of said positioning stem when said rotatable sleeve is at the socket-retaining position.

* * * * *